US010948185B2

(12) United States Patent
Rouwenhorst et al.

(10) Patent No.: US 10,948,185 B2
(45) Date of Patent: Mar. 16, 2021

(54) THERMOACOUSTIC PRECURSOR METHOD AND APPARATUS

(71) Applicant: IFTA INGENIEURBURO FUR THERMOAKUSTIK GMBH, Grobenzell (DE)

(72) Inventors: Driek Rouwenhorst, Munich (DE); Jakob Hermann, Engehofen (DE)

(73) Assignee: IFTA INGENIEURBURO FUR THERMOAKUSTIK GMBH, Grobenzell (DE)

( * ) Notice: Subject to any disclaimer, the term of this patent is extended or adjusted under 35 U.S.C. 154(b) by 286 days.

(21) Appl. No.: 15/735,950

(22) PCT Filed: Jun. 10, 2016

(86) PCT No.: PCT/EP2016/000963
§ 371 (c)(1),
(2) Date: Dec. 12, 2017

(87) PCT Pub. No.: WO2016/198164
PCT Pub. Date: Dec. 15, 2016

(65) Prior Publication Data

US 2018/0142891 A1 May 24, 2018

(30) Foreign Application Priority Data

Jun. 12, 2015 (EP) ..... 15001745
Nov. 20, 2015 (EP) ..... 15003308

(51) Int. Cl.
*F23N 5/16* (2006.01)

(52) U.S. Cl.
CPC ..... *F23N 5/16* (2013.01); *F23N 2241/20* (2020.01)

(58) Field of Classification Search
CPC ..... F05D 2260/96; F05D 2260/962; F05D 2260/964; F23N 5/16; F23R 2900/00013
See application file for complete search history.

(56) References Cited

U.S. PATENT DOCUMENTS 5,005,353 A * 4/1991 Acton ..... F01D 17/02 60/39.281
5,428,951 A * 7/1995 Wilson ..... F23R 3/18 60/776

(Continued)

FOREIGN PATENT DOCUMENTS

EP 1286031 A1 2/2003

OTHER PUBLICATIONS

European Patent Office—International Search Report of the International Searching Authority dated Aug. 12, 2016 for correlating International Application No. PCT/EP2016/000963 (3 pgs).

(Continued)

*Primary Examiner* — Gerald L Sung
(74) *Attorney, Agent, or Firm* — Womble Bond Dickinson (US) LLP

(57) ABSTRACT

Method of determining at least one stability margin for a combustor (12), by obtaining modal characteristics of at least one spectral peak in the thermoacoustic dynamics, as well as determining the stability margin for the combustor (12) on the basis of the obtained modal characteristics, and an apparatus being adapted to carry, out said method.

11 Claims, 3 Drawing Sheets

(56) References Cited

U.S. PATENT DOCUMENTS 5,445,517 A * 8/1995 Kondou ..... F23N 5/16 431/18
5,544,478 A * 8/1996 Shu ..... F23N 5/082 60/773
5,791,889 A * 8/1998 Gemmen ..... F23N 5/16 431/1
6,205,765 B1 * 3/2001 Iasillo ..... F02C 7/22 431/114
6,464,489 B1 * 10/2002 Gutmark ..... F23N 5/16 431/1
2002/0162317 A1 * 11/2002 Banaszuk ..... F23N 5/16 60/204
2005/0144955 A1 * 7/2005 Handelsman ..... F23N 5/16 60/772
2005/0247064 A1 11/2005 Lieuwen
2006/0266045 A1 * 11/2006 Bollhalder ..... F23N 5/242 60/725
2007/0062196 A1 * 3/2007 Gleeson ..... F23N 5/242 60/722
2007/0271927 A1 * 11/2007 Myers ..... F02C 9/28 60/776
2008/0072605 A1 * 3/2008 Hagen ..... F23R 3/34 60/776
2008/0134684 A1 * 6/2008 Umeh ..... F02C 7/22 60/772
2009/0005952 A1 * 1/2009 Tonno ..... G05B 13/041 701/100
2012/0279229 A1 * 11/2012 Zinn ..... F02C 7/057 60/773
2015/0081233 A1 * 3/2015 An ..... F23M 20/005 702/56
2017/0219208 A1 * 8/2017 Song ..... F23N 5/242

OTHER PUBLICATIONS

European Patent Office—Written Opinion of the International Searching Authority dated Aug. 12, 2016 for correlating International Application No. PCT/EP2016/000963 (5 pgs).
European Patent Office—International Preliminary Report on Patentability for related International Application No. PCT/EP2016/000963 (6 pgs).

* cited by examiner

THERMOACOUSTIC PRECURSOR METHOD AND APPARATUS

CROSS-REFERENCE TO RELATED APPLICATIONS

This patent application is a U.S. National Phase application under 35 U.S.C. § 371 of International Application No, PCT/EP20156/00963, filed on Jun. 10, 2016, entitled THERMOACOUSTIC PRECURSOR METHOD AND APPARATUS, which claims priority from European Patent Application No, 15001745.7, filed on Jun. 12, 2015; and from European Patent Application No. 15003308.2, filed on Nov. 20, 2015.

FIELD OF THE INVENTION

The present invention relates to a method and an apparatus for monitoring a combustor (e.g. a gas turbine) and, particularly, for monitoring the dynamic stability margin of combustor (e.g. a gas turbine).

BACKGROUND OF THE INVENTION

Several methods to determine a stability margin of a combustor or combustion chamber have been proposed. Approaches to determine a stability margin are usually developed and/or validated on laboratory combustors. The degree of effectivity in applying the same strategies to full scale industrial combustors and, particularly, annular gas turbine combustors and full gas turbine combustors is questionable. For example, the measurement location may corrupt the stability margin estimation.

Object of the Invention

It is an object of the present invention to provide solutions for a reliable determination of a stability margin of a combustor and, for example, an annular gas turbine combustors or a full gas turbine combustor.

SUMMARY OF THE INVENTION

To solve the above object, the present invention provides subject-matter according to the independent claims. Preferred embodiments of the present invention are defined in dependent claims.

A method of determining a stability margin for a combustor by assessing modal dynamics of the thermoacoustic system is disclosed. Assessment of modal dynamics of the thermoacoustic system is understood to relate to the characterization of the thermoacoustic vibration (modes) originating from the excitation by the combustion process. The thermoacoustic phenomenon may also be referred to as combustion dynamics or combustion instability.

In general, modal characteristics of at least one spectral peak in an acoustic field of the combustor are obtained and at least one stability margin is determined based on the obtained modal characteristics. In some embodiments, the modal characteristics of the at least one spectral peak in the acoustic field of the combustor may comprise modal contributions. In particular, modal contributions to the at least one spectral peak of the acoustic field may be determined by obtaining a basis of modal vectors (e.g. comprising harmonic functions) and by mode decomposition of measured acoustic amplitudes onto the obtained basis.

Furthermore, a computer program product, an apparatus and a system for determining a stability margin are disclosed.

In the following, possible embodiments are defined:

The method may comprise obtaining modal characteristics of at least one spectral peak in an acoustic field of the combustor, determining at least one stability margin for the combustor based on the obtained modal characteristics of the at least one spectral peak in the acoustic field of the combustor.

In the method, the step of obtaining the modal characteristics may comprise identifying the thermoacoustic system, based on a state space model structure with stochastic input, to estimate eigenvectors and/or
decay rates of eigenmodes and/or
eigenfrequencies and/or
stochastic forcing amplitude.

In the method, the step of obtaining the modal characteristics may comprise assuming at least one pre-defined modal vector, in particular at least one pre-defined modal vector corresponding to a standing acoustic wave or a traveling acoustic wave, mode decomposition based on the at least one pre-defined modal vector to obtain modal amplitudes, and estimating a decay rate and/or frequency of at least one of the modal amplitudes.

In the method, the at least one stability margin for the combustor may be determined as the estimated decay rate.

The method may comprise that the thermodynamic system is decomposed onto at least one estimated eigenvector and the at least one stability margin for the combustor is determined based on the modal amplitude on basis of an estimated eigenvector.

The method may comprise that the thermodynamic system is decomposed onto at least one assumed, pre-defined modal vector, and the at least one stability margin for the combustor is determined based on the modal amplitude on basis of an assumed, pre-defined modal vector.

In the method, the combustor may be an annular combustor, wherein the modal characteristics may be defined on basis of an azimuthal coordinate and an azimuthal mode order m, and/or the at least one modal vector is based on the azimuthal mode number m.

In the method, the at least one spectral peak may be determined based on acoustic signals measured or deduced in the combustor.

Computer program product including program code configured to, when executed in a computing device, carry out the steps of one of the preceding claims.

The apparatus may comprise at least one of:

- a mode analyzer device being adapted to obtain modal characteristics of at least one spectral peak in an acoustic field of the combustor and
- a mode decomposer device being adapted to decompose the thermoacoustic system onto a modal vector, as well as a stability margin determination device being adapted to determine at least one stability margin for the combustor based on at least one of the obtained modal characteristics and the modal vector decomposition.

The apparatus may further comprise at least two acoustic sensors to measure or deduce acoustic signals in the combustor.

In the apparatus, the mode analyzer device may be adapted to determine the stability margin for the combustor based on a decay rate of the at least one acoustic mode, or the stability margin determination device may be adapted to determine the stability margin for the combustor based on an amplitude of the modal characteristics, and/or an acoustic noise in the combustor.

In the apparatus, the mode analyzer device or the mode decomposed device may be adapted to determine the acoustic noise in the combustor on the basis of acoustic signals measured or deduced in the combustor.

In the apparatus, the combustor may be an annular combustor, wherein the mode decomposer device may be adapted to decompose the acoustic field onto a modal vector, based on an azimuthal mode order m, and/or the mode analyzer device may be adapted to determine the modal characteristics on basis of an azimuthal mode order m.

The system may comprise an apparatus according to one of the above embodiments claims and a combustor.

The system may further comprise a controller being adapted to control the operation of the combustor based on the stability margin for the combustor, determined by the stability margin determination device of the apparatus or the mode analyzer device.

In the system, the combustor may be the combustor of an annular gas turbine.

In the system, the combustor may be a gas turbine combustor.

In the system, the modal characteristics may be obtained on basis of fluctuating heat release rate of the combustor.

In the system, at least one stability margin may be determined, based on the obtained modal characteristics of the at least one spectral peak in the fluctuating heat release rate of the combustor.

BRIEF DESCRIPTION OF THE DRAWINGS

In the following, the present invention is described with reference to the attached drawings, which show.

DESCRIPTION OF PREFERRED EMBODIMENTS

Figure 1:
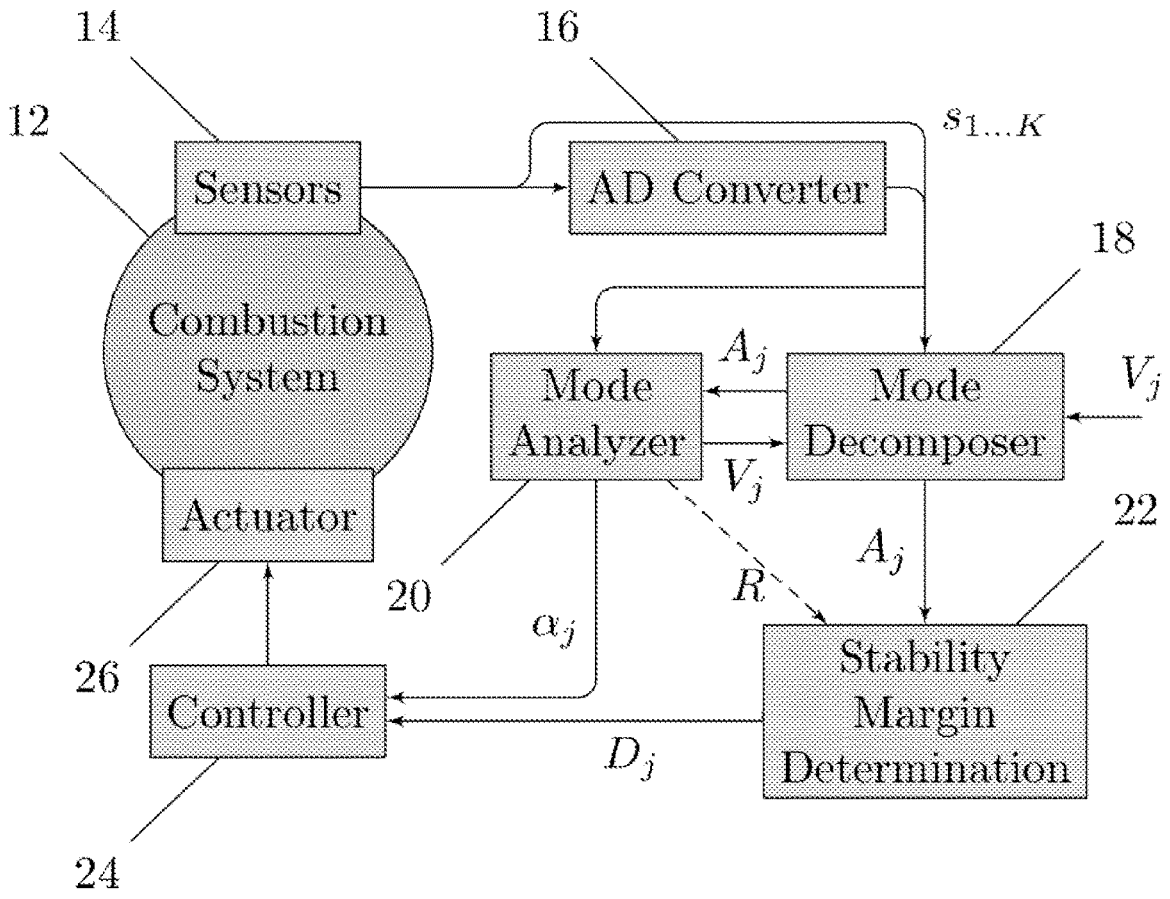
FIG. 1 a schematic illustration of a system according to the present invention including an apparatus according to the present invention, FIG. 2 a schematic illustration of the annular geometry of a combustor (e.g. annular gas turbine), FIG. 3 exemplary spectra of a split mode, yielding non-degenerate (split) eigenmodes FIG. 4 exemplary graphical representation of standard precursors, FIG. 5 exemplary graphical representations of tailored precursors.
Figure 2:
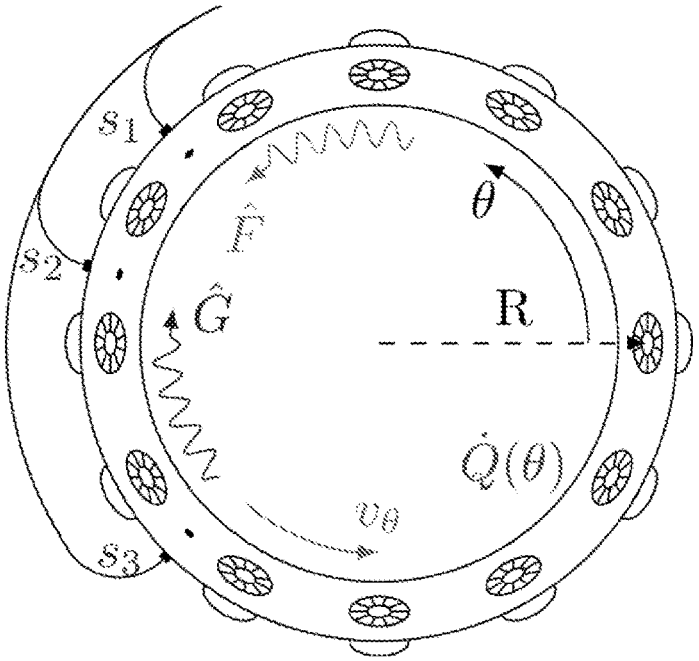

FIG. 1 illustrates an example of a system 10, which comprises a combustor 12. In FIG. 2, the combustor 12 is illustrated as annular combustor, for example an annular gas turbine. However, the present invention is not limited to annular combustors and can be applied to any combustor, wherein thermoacoustic modes have nondegenerate eigenvalues, such as can-annular combustors. A thermoacoustic mode with nondegenerate eigenvalues may be understood as multiple coexisting modes with similar eigenfrequencies. Because, if the eigenfrequencies are close together, the modes may be coupled and may be hard to separate spectrally. As a result, they may be observed and considered as one thermoacoustic mode.

Returning to FIG. 1, the system 10 further comprises at least one sensor device 14 arranged and adapted to measure acoustic quantities in the combustor 12. The combustor may comprise at least one combustion chamber and a combustor plenum. Acoustic fields in any component of the combustor may be described by the term acoustic field of the combustor. The acoustic quantities can either be measured directly for example with a pressure transducer, or derived from a sensor measuring another quantity (e.g. heat release fluctuations of the flame or mechanical oscillations of combustor components), such as photomultiplier tubes for chemiluminescence or such as an accelerometer.

As known to the skilled person, acoustics and flame dynamics are inherently coupled in thermoacoustic modes. The acoustics causes heat release fluctuations of the flame and vice versa. Therefore, the heat release rate can be considered as an indirect representation or indication of the acoustics. In some embodiments, measurements representing heat release rate fluctuations are used instead of acoustic signals. The heat release rate can for example be quantified with help of the chemiluminescence from the combustion process, measured for instance with a Photomultiplier Tube (PMT) and optionally an optical bandpass filter.

Accordingly, as will be apparent to the skilled person, a sensor for measuring a quantity indicative of an acoustic field of the combustor may be placed in, adjacent to or near any component of the combustor.

The at least one sensor device 14 is adapted to output sensor signals $s_1, s_2 \ldots s_K$, indicative of respective measurements of the acoustic field, e.g. with K sensors. Sensor signals from the at least one sensor device 14 may be provided to an (optional) analog-digital converter device 16, in the case the at least one sensor device 14 provides analog signals, while digital signals are needed for processing steps and devices, respectively, described in the following. The analog-digital converter device 16 is not necessary in the case analog signals from the at least one sensor device 14 can be processed by said processing steps and devices, respectively, described in the following. Nor is the analog-digital converter device 16 necessary in case the at least one sensor device 14 provides digital output signals. Each one of the at least one sensor device may be adapted to output one or more of the sensor signals.

The sensor signals $s_1, s_2 \ldots s_K$ are processed by a mode analyzer 20 as described further below.

The mode analyzer device 20 estimates and outputs modal characteristics. The estimated modal characteristics include information indicating identified decay rate $\alpha$, modal eigenvector V and/or process noise R of at least one eigenmode per monitored spectral peak in the acoustic field of the combustor 12. The modal eigenvectors can have any basis of spatial harmonic functions with order m around the circumference of the combustion chamber and/or combustor plenum. The eigenvectors can describe for instance standing waves, traveling waves or combinations thereof. The at least one decay rate estimate $\alpha$ can be used as a precursor for thermoacoustic stability directly.

In some embodiments, the mode analyzer device 20 analyzes modal amplitudes $A_j$ of at least one spectral peak in the acoustic field of the combustor 12, generated by the mode decomposer device 18 described further below.

In some embodiments, the sensor signals $s_1, s_2 \ldots s_K$ are processed by a mode decomposer device 18, which projects the signals onto a modal vector basis ($V_j$). The said vector basis can be set manually or set as the eigenvector estimate, identified by the mode analyzer device 20. If the vector basis is set manually, it typically corresponds to traveling or standing wave solutions of the acoustic field with spatial mode order m around the circumference of the combustor 12. The mode decomposer device 18 outputs modal amplitudes $A_j$ of at least one spectral peak in the acoustic field corresponding to mode order m of the combustor 12. For example, the output of the wave decomposer device 18 may indicate acoustic clockwise (F) and anticlockwise (G) waves, which may be provided to a stability margin determination device 22.

The outputs of the mode decomposer device 18 may be provided to a stability margin determination device 22, which determines or, at least, estimates at least one stability margin $D_j$ for the combustor 12. To this end, the stability margin determination device 22 uses the outputs $A_j$ of the mode decomposer device 18 as basis. In some embodiments, the process noise R identified by the mode analyzer device 20 is used, along with the modal amplitudes $A_j$, to determine a stability margin output.

A determined/estimated stability margin may be used to control the combustion process. To this end, information on the determined/estimated stability margin is provided to a controller 24. The controller 24 can be a technical controller for automatically controlling the combustor, for example, by using a pre-programmed algorithm, can be a human controller or operator. The combustor can be controlled by means of an actuator 26, which changes the combustion process parameters, such as, but not limited to, fuel split, staging strength or fuel flow to the pilot burner.

In general, a system according to the invention comprises a mode analyzer device and/or a mode decomposer device, which as illustration may operate according to the following considerations.

Modeling azimuthal modes in annular geometries, an azimuthal mode order m comprises two eigenvalues with corresponding eigenvectors. In some cases, these eigenvalues are equal and the eigenvectors are orthogonal, leading to so-called degenerate eigenvalues. In practical systems, however, two distinct solutions may be possible because of side effects, including an azimuthal bulk velocity through the combustion chamber and azimuthally varying flame response characteristics (angular variation of the flame response).

On the one hand, an azimuthal bulk velocity in the combustion chamber (or combustor annulus) causes, at least promotes independent acoustic clockwise (F) and anticlockwise (G) waves with (slightly) different frequency and decay rate.

On the other hand, azimuthally varying flame response characteristics can cause standing wave solutions, with frequency and decay rate depending on the angular orientation of the standing wave.

In general, combustors show both phenomena, yielding mixed modes, i.e. combinations of standing and traveling wave behavior.

The azimuthal eigenmodes can be fully described by two complex amplitudes. Their amplitudes control the contribution of two independent harmonic basis functions around the circumference with mode order m.

In order to predict the moment where the lowest decay rate will cross zero resulting in exponential growth, monitoring a mix of the two eigenmodes will yield a bias towards stable operation. For a more accurate or more reliable stability margin determination, the two eigenmodes at mode order m may be resolved and considered individually.

To this end, a mode decomposition of measured acoustic signals may be carried out. Mode decomposition may be based on an eigenvector basis that describes the acoustic field of the considered mode order m. Two main strategies are proposed: (a) Assuming at least one prescribed or pre-defined modal vector, such as a standard and/or known vector; (b) Obtaining an estimate of the eigenvectors by (online) identification of the system. In some embodiments, one of strategies (a) and (b) may be carried out. Alternatively, in some embodiments, both strategies (a) and (b) can be combined.

Strategy (a) predominantly follows the outer loop of the block diagram in FIG. 1, i.e. along the sequence of reference numbers 16-18-22-24. An example of the variant (a) is to decompose the signals in pure traveling waves. The signal can be decomposed in a clockwise traveling wave $\hat{F}$ and anticlockwise wave $\hat{G}$ using the following steps. Construct a matrix C stating what the sensor outputs should be for given traveling wave amplitudes.

$$\begin{bmatrix} \hat{s}_1 \\ \hat{s}_2 \\ \cdots \\ \hat{s}_K \end{bmatrix} = C \begin{bmatrix} \hat{F} \\ \hat{G} \end{bmatrix} \quad [1]$$

The hats denote that the variables might be analytic, i.e. complex variables. For two sensor channels, the decomposed traveling waves can now be found using the inverse of C $$\begin{bmatrix} \hat{F} \\ \hat{G} \end{bmatrix} = C^{-1} \begin{bmatrix} \hat{s}_1 \\ \hat{s}_2 \\ \cdots \\ \hat{s}_K \end{bmatrix} \quad [2]$$

For more than two sensors, the Moore-Penrose pseudo-inverse can be used, yielding the decomposition in a least square sense.

Preferably, the above decomposition is performed in Fourier domain. Fast Fourier Transforms (FFT) are often already implemented and optimized in monitoring hardware and/or software of a combustion system. The decomposed waves are obtained in frequency domain directly where the modal peaks can be analyzed visually and separated from other modes by means of a bandpass filter. As compared with the time domain, in the frequency domain more information per sensor is readily obtained, since the data comes with both amplitude and phase information.

An example for the precursors based on the average modal amplitudes is given in equation [3], determined from a sample with N time steps.

$$D_1 = \log\left(\frac{1}{N}\sum_{n=1}^{N}|\hat{F}_n|\right) \quad [3]$$

$$D_2 = \log\left(\frac{1}{N}\sum_{n=1}^{N}|\hat{G}_n|\right)$$

When the strength of the combustion noise R, exciting the acoustic field, is known or estimated, it can be used in defining the following precursors:

$$D_1 = RN/\Sigma_{n=1}^{N}|\hat{F}_n|$$

$$D_2 = RN/\Sigma_{n=1}^{N}|\hat{G}_n| \quad [4]$$

The combustion noise R can be fixed to a reasonable number, or estimated online from measured data when performing output-only modal identification by a mode analyzer device. The expected value for the precursor definition in equation [4] is monotonically increasing with the decay rates of the corresponding traveling waves. For marginal stability, the precursor value will go to zero.

Evolution of precursors based on modal amplitudes can be monitored for different modal vectors individually, preferably normalized by the estimate of noise level R, exciting the system around the frequency of the considered mode. Preferred implementations of the mode decomposer and stability margin determination device were explained here with traveling waves as basis vector of the system, but the methods apply under any change of basis, including all standing and mixed wave bases.

Strategy (b) predominantly follows the smaller clockwise loop in FIG. 1, i.e. along the sequence of reference numbers 16-20-24. An example of variant (b) may involve system identification on basis of the sensor signals. In general, the method for identifying the thermoacoustic system disclosed herein may be practiced for a variety of purposes, including but not limited to determining a stability margin. Further applications include the determination of mode shapes and eigenfrequencies or passive control strategies to obtain a more stable system.

The used model structure for system identification is a state space representation, with acoustic variables in state vector x, for example traveling waves $\hat{F}$ and $\hat{G}$:

$$x_{n+1}=Ax_n+w_n$$

$$\hat{S}_n=Cx_nv_n \qquad [5]$$

The subscript n denotes discrete steps in time. Output-only modal identification methods can estimate matrix A and the stochastic forcing vector w. The state-space model in total can be identified by the Stochastic Subspace Identification algorithm (SSI). The eigenvalues λ and eigenvectors V are retrieved by solving the eigenvalue problem of system matrix A, wherein w is representative for the noise strength exciting the system. The eigenvalues contain both the decay rate and the eigenfrequency of the eigenmodes. When the sensor noise can be neglected, A can be determined by ordinary least squares, with residual w.

Alternatively or additionally, Fourier Domain Decomposition (FDD) and fitting strategies can be applied to estimate the eigenvectors only. Mode decomposition onto these eigenvectors can then be applied to obtain the dynamic amplitudes of the eigenmodes. These modal amplitudes can be used to find a precursor following strategy (a), or they can be fed back to the modal analyzer to find the remaining modal characteristics.

To find the eigenvalues from a modal amplitude A, the following model is used for all amplitudes independently $$A_{n+1}-\lambda A_n+w_n \qquad [6]$$

Alternatively, the decay rate can be found by fitting the autocorrelation function envelope of the modal amplitude A.

The standard deviation of (a long) combustion noise forcing vector w gives the estimate of noise strength R. The estimate of R can be used in the stability margin determination device as described in strategy (a).

When the decay rate is estimated, it can serve as a quantitative stability margin. This strategy will be most suited for slowly changing system parameters, because the identification process requires large data sets. Precursors based on modal amplitude (strategy (a)) can be monitored as quantitative measure to represent short term stability changes with the estimated decay rate as reference.

Furthermore, identification can provide more information about the system parameters which can prove to be helpful in taking the right control action to manage the stability margin of the system. For example, the orientation of a standing wave can suggest at what burners fuel staging should be applied to gain stability margin. Moreover, subcritical and supercritical bifurcation points could be predicted with help of the estimated eigenfrequencies, when sufficient information about the flame response is known. This may be a reason, for example, to retain a larger or smaller stability margin for a specific mode.

Figure 3:
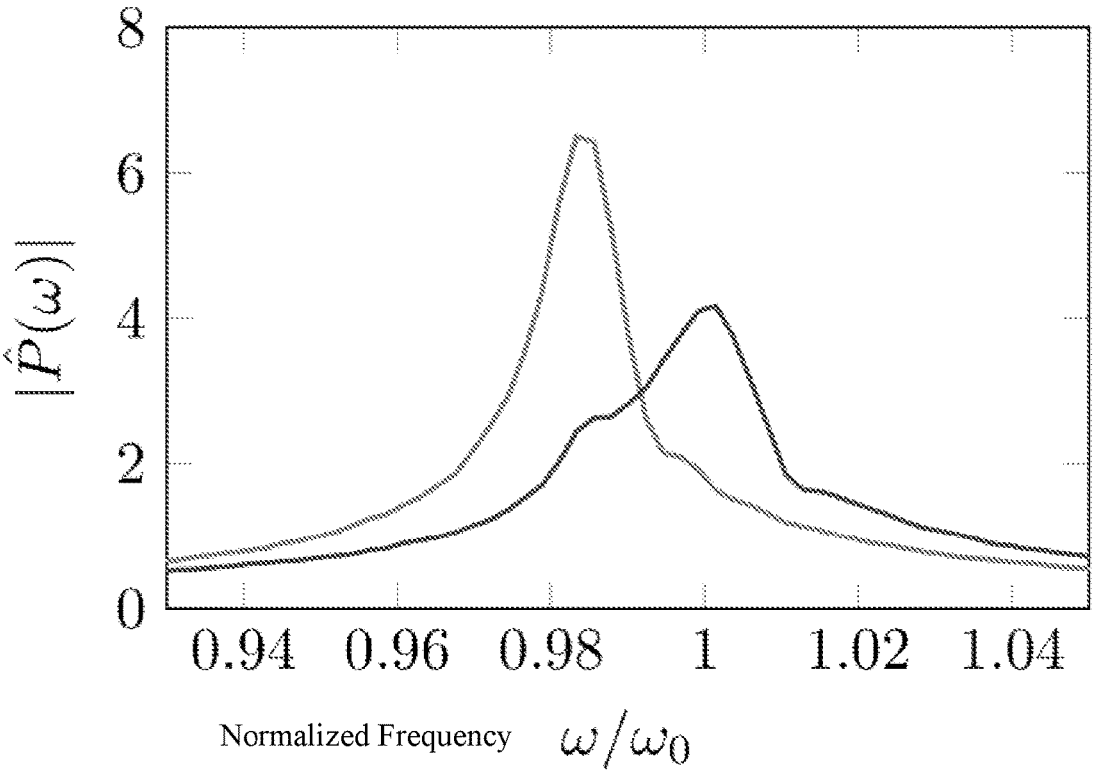

FIG. 3 shows exemplary spectra of clockwise and anticlockwise waves of a split, i.e. nondegenerate, mode.

Figure 4:
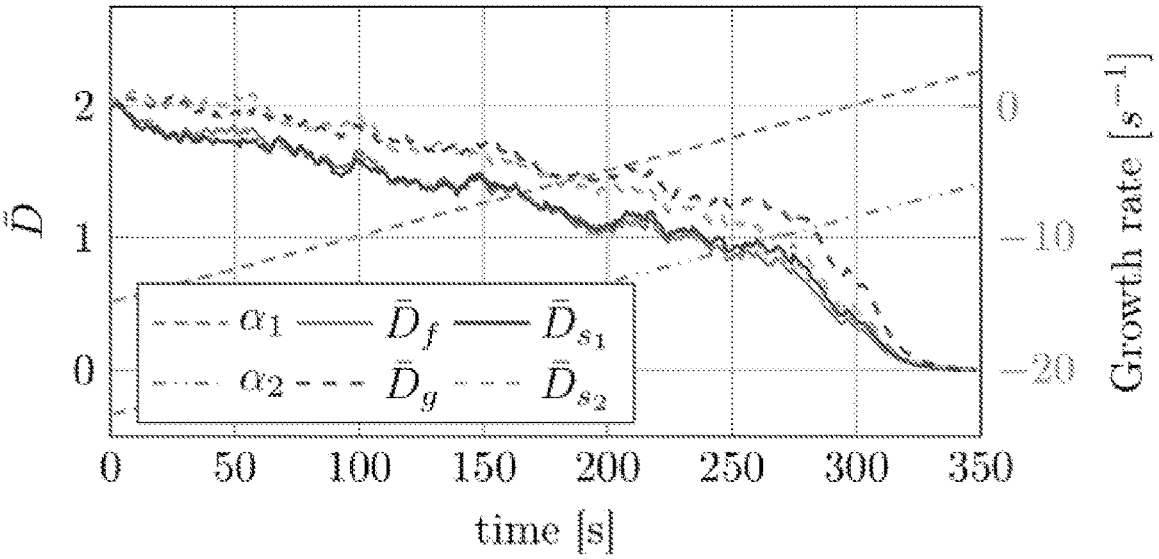

FIG. 4 shows the precursors based on traveling wave and standing wave amplitudes, applied to simulated data of a (annular) thermoacoustic system in a (annular) combustion chamber, using Equation [4] according to strategy (a) (comparable results are obtained in the case of any thermoacoustic system in a combustion chamber in general). The damping in the model was decreased linearly such that the least stable mode crosses zero after 297 seconds. Other parameters were fixed in such way that the least stable mode lies in the mixed zone with $|\hat{F}/\hat{G}|=2.6$.

An exponential moving average (EMA) with exponent of $0.25\ s^{-1}$ is applied to smooth the results. The precursors go down towards zero as the damping decreases. From about 280 seconds the values drop down quickly and go to zero asymptotically with the exponent of the EMA-filter. The value for $\overline{D}_f$ is clearly lower than $\overline{D}_g$, which could be expected by the amplitude ratio of 2.6. One of the standing wave precursors practically shows the same stability margin, from which it can be deduced that the system is in the mixed region. An overbar denotes that the quantity is estimated on basis of a finite time window.

Figure 5:
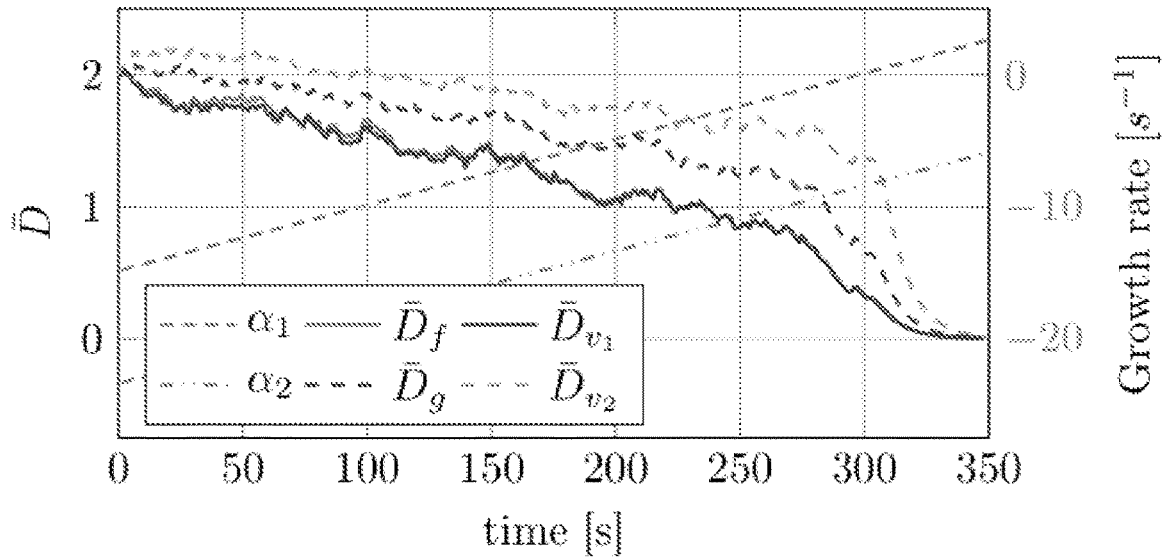

In some embodiments, it may be preferable to obtain modal characteristics by identifying the thermoacoustic system based on a state space model structure with stochastic input. FIG. 5 shows the precursors (identified eigenmodes) applied to simulated data of a (e.g. annular) thermoacoustic system in a (e.g. annular) combustion chamber, using identified eigenvectors and compared to the variant of analysis based on traveling waves. Note that this is a combination of strategy (a) and (b). Again Equation [4] defines the precursor, but the modal bases are taken as the identified eigenvectors. An overbar denotes that the quantity is estimated on basis of a finite time window. System identification of the eigenvectors is applied on the first half of the time series. Using these vectors, the precursors ($D_{v1}$, $D_{v2}$) in FIG. 5 are generated. Compared to the traveling wave solutions ($D_f$, $D_g$), the difference between the two modes (v1, v2) becomes more pronounced, mainly increasing the stability margin estimate for the more stable eigenmode. For the same damping, both eigenmodes result in the same value for the precursor, compare $\overline{D}_{v_i}\approx 1.6$, for $\alpha_i=-10\ s^{-1}$. This suggests that the decomposition on basis of the identified eigenvectors was successful in making the stability margin determination more accurate in the present embodiment. Only after a certain period of exponential growth of the least stable mode, the second mode is also affected by the imperfect identification of the eigenvectors. An instantaneous value for the amplitude gives very poor information about the stability; it is rather the expected value (i.e. long-time average) that can give a reliable quantification of the state of the system. A trade-off has to be made between the averaging time and the ability to observe temporal development of the system itself. Performing identification over a longer period of stable operation can yield an estimate of the decay rate (strategy (b)), to which amplitude based precursors can be related.

In this particular example, the decomposition using a pre-defined basis of traveling waves and using a basis of the identified eigenvectors yield approximately the same precursor result for the least stable mode which is the mode of interest. However, depending on the system, this does not have to be the case. A precursor based on a properly identified vector basis will yield the best results. If this is not available, the lowest precursor of standing wave and traveling wave decomposition may be taken as the stability margin for the system.

Figure 6:
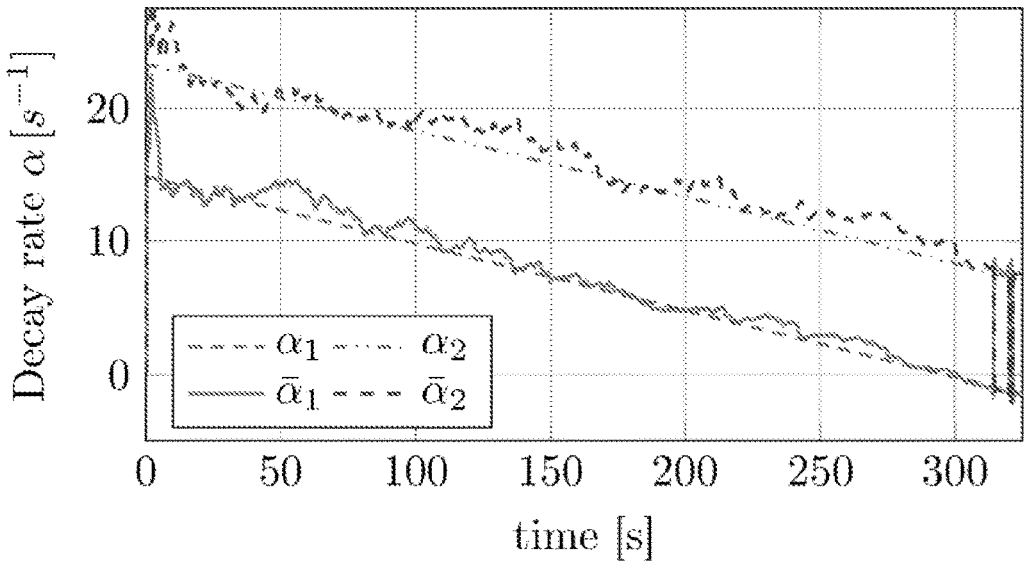
FIG. 6 exemplary graphical representation of identified decay rates as precursors

FIG. 6 shows the estimated decay rate as the stability margin following strategy (b). The estimated values for the decay rates are very close to the theoretical values a. Because the dynamic parameters of the thermoacoustic system change slowly, a proper estimate of the decay rate can be obtained. In this case, it is the preferred precursor, since the quantity has a physical meaning.

What is claimed is:

1. A non-transitory machine readable storage medium having stored thereon, which when executed by a computing device, causes the computing device to perform operations for determining a stability margin assessing modal dynamics of a thermoacoustic system, the stability margin defining a dynamic stability of a thermoacoustic combustion process on the basis of eigenmodes of standing waves, travelling waves, or a combination thereof in the combustor, the operations comprising: measuring, with at least one sensor, sensor data indicative of measurements of an acoustic field in the combustor; obtaining, from the sensor data, modal characteristics of at least one eigenmode of the eigenmodes of a spectral peak of the acoustic field in the combustor; determining the stability margin for the combustor based on the obtained modal characteristics of the at least one eigenmode of the eigenmodes of the spectral peak of the acoustic field in the combustor, the stability margin predicting an exponential growth of an amplitude of the at least one eigenmode of the eigenmodes in the combustor; and controlling an actuator that adjusts combustion process parameters of the combustor based on the stability margin determination.

2. A method of determining a stability margin for a combustor by assessing modal dynamics of a thermoacoustic system, comprising:

measuring, with at least one sensor, sensor data indicative of measurements of an acoustic field in the combustor;

obtaining, by a computing device from the sensor data, modal characteristics of at least one spectral peak of an acoustic field in the combustor, wherein obtaining modal characteristics comprises identifying the thermoacoustic system, based on a state space representation with stochastic input, to estimate a decay rate of at least one eigenmode of the at least one spectral peak of the acoustic field in the combustor;

determining, by the computing device, at least one stability margin for the combustor based on the estimated decay rate of the at least one eigenmode of the at least one spectral peak of the acoustic field in the combustor; and controlling, by a controller device coupled with the computing device, an actuator that adjusts combustion process parameters of the combustor based on the at least one stability margin determination.

3. A method of determining a stability margin for a combustor by assessing modal dynamics of a thermoacoustic system, the stability margin defining a dynamic stability of a thermoacoustic combustion process on a basis of eigenmodes of standing waves, travelling waves, or a combination thereof in the combustor, the method comprising: measuring, with at least one sensor, sensor data indicative of measurements of an acoustic field of the combustor; obtaining, by a computing device from the sensor data, modal characteristics of at least one eigenmode of the eigenmodes of a spectral peak of the acoustic in the combustor; determining, by the computing device, the stability margin for the combustor based on the obtained modal characteristics of the at least one eigenmode of the eigenmodes of the spectral peak of the acoustic field in the combustor, the stability margin predicting an exponential growth of an amplitude of the at least one eigenmode of the eigenmodes in the combustor; and controlling, by a controller device coupled with the computing device, an actuator that adjusts combustion process parameters of the combustor based on the stability margin determination.

4. The method according to claim 3, wherein the spectral peak is determined based on a fluctuating heat release rate of the combustor.

5. The method according to claim 3, wherein the spectral peak is determined based on acoustic signals measured directly or deduced from another measurement.

6. The method according to claim 3, wherein the modal characteristics are defined on basis of an azimuthal coordinate and an azimuthal mode order m, and/or at least one modal vector is based on the azimuthal mode number m.

7. The method according to claim 3, wherein the obtaining modal characteristics comprises: identifying the thermoacoustic system, based on a state space representation with stochastic input, to estimate eigenvectors and/or a decay rate of the at least one eigenmode of the eigenmodes and/or process noise.

8. The method according to claim 7, wherein the stability margin for the combustor is determined as the estimated decay rate.

9. The method according to claim 7, wherein the thermoacoustic system is decomposed onto at least one of the estimated eigenvectors, and the stability margin for the combustor is determined based on a modal amplitude on basis of the at least one of the estimated eigenvectors.

10. The method according to claim 3, wherein the obtaining modal characteristics comprises: assuming at least one pre-defined modal vector corresponding to a standing acoustic wave of the standing waves or a travelling acoustic wave of the travelling waves, using mode decomposition based on the at least one pre-defined modal vector to obtain at least one modal amplitude, and estimating a decay rate and/or frequency of the at least one of the modal amplitude.

11. The method according to claim 10, wherein the thermoacoustic system is decomposed onto the at least one pre-defined modal vector, and the stability margin for the combustor is determined based on the at least one modal amplitude on basis of the at least one predefined modal vector.

* * * * *